US008737883B2

(12) United States Patent
Iwasaki

(10) Patent No.: US 8,737,883 B2
(45) Date of Patent: May 27, 2014

(54) CHARGING DEVICE AND IMAGE FORMING APPARATUS

(71) Applicant: Fuji Xerox Co., Ltd., Tokyo (JP)

(72) Inventor: Jin Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 36 days.

(21) Appl. No.: 13/647,954

(22) Filed: Oct. 9, 2012

(65) Prior Publication Data

US 2013/0223885 A1 Aug. 29, 2013

(30) Foreign Application Priority Data

Feb. 27, 2012 (JP) ..... 2012-040070

(51) Int. Cl.
*G03G 15/02* (2006.01)

(52) U.S. Cl.
USPC ..... 399/175

(58) Field of Classification Search
CPC ..... G03G 15/0233
USPC ..... 399/175, 176
See application file for complete search history.

(56) References Cited

U.S. PATENT DOCUMENTS

| | | | | | |
|---|---|---|---|---|---|
| 5,245,386 | A * | 9/1993 | Asano et al. | ..... | 399/175 |
| 5,323,215 | A * | 6/1994 | Ohtaka et al. | ..... | 399/89 |
| 5,455,661 | A * | 10/1995 | Yoshida et al. | ..... | 399/175 |
| 5,486,907 | A * | 1/1996 | Watanabe et al. | ..... | 399/175 |
| 6,219,509 | B1 * | 4/2001 | Komiya et al. | ..... | 399/168 |
| 6,272,303 | B1 * | 8/2001 | Takeda | ..... | 399/175 |
| 6,301,459 | B1 * | 10/2001 | Ishiyama et al. | ..... | 399/175 |

FOREIGN PATENT DOCUMENTS

| | | | |
|---|---|---|---|
| JP | 4-32866 | A | 2/1992 |
| JP | 4-32869 | A | 2/1992 |
| JP | 10-90978 | A | 4/1998 |
| JP | 2002-40762 | A | 2/2002 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

A charging device includes a charging member that is rotatably provided in contact with a surface of a charge member, and that charges the surface of the charge member with contactors thereof. The contactors contact the surface of the charging member at charging areas. Directions of inclinations of the contactors differ in accordance with the charging areas.

9 Claims, 11 Drawing Sheets

| CHARGING BRUSH | ONLY BRUSH ROLLER 81 | ONLY BRUSH ROLLER 82 | BRUSH ROLLERS 81, 82 |
|---|---|---|---|
| UNEVEN POTENTIAL | 35 V | 38 V | 13 V |

FIG. 10

| CHARGING BRUSH | UPSTREAM −1000 V<br>DOWNSTREAM −1200 V | UPSTREAM/DOWNSTREAM −1200 V |
|---|---|---|
| UNEVEN POTENTIAL | 38 V | 13 V |

FIG. 13A
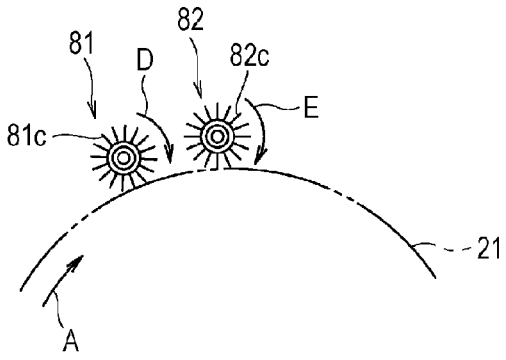
FIG. 13B
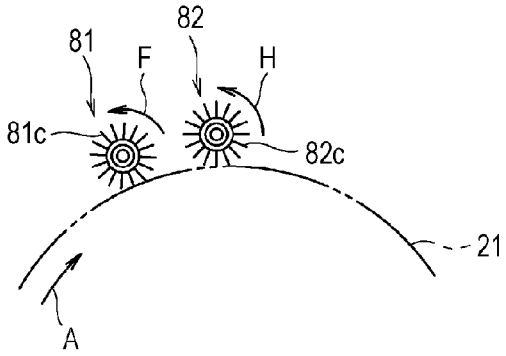
FIG. 14
| | CHARGING BRUSH | TWO FIXED BRUSHES | TWO ROTATING BRUSHES ROTATE IN OPPOSITE DIRECTION/ PERIPHERAL SPEEDS DIFFER | TWO ROTATING BRUSHES ARE DRIVEN |
|---|---|---|---|---|
| UNEVEN POTENTIAL | INITIAL | 15 V | 13 V | 13 V |
| | FOLLOWING 5kPV | 42 V | 36 V | 20 V |

CHARGING DEVICE AND IMAGE FORMING APPARATUS

CROSS-REFERENCE TO RELATED APPLICATIONS

This application is based on and claims priority under 35 USC 119 from Japanese Patent Application No. 2012-040070 filed Feb. 27, 2012.

BACKGROUND (i) Technical Field

The present invention relates to a charging device and an image forming apparatus.

(ii) Related Art

A corona discharge device that is widely used as a charging device that charges a photoconductor drum of an image forming apparatus, such as a copying machine or a printer, is desirable in that the corona discharge device uniformly charges the surface of the photoconductor drum to a predetermined potential. However, such a corona discharge device generates ozone because it makes use of corona discharge.

In contrast, a brush charging device that charges the surface of a photoconductor drum by electric discharge as a result of bringing a conductive brush to which bias voltage is applied into contact with the surface of the photoconductor drum is desirable in that the generation of ozone is suppressed. The brush charging device includes an insulating substrate, a conductive layer provided on the insulating substrate, and a conductive brush provided on the conductive layer.

SUMMARY

According to an aspect of the invention, there is provided a charging device including a charging member that is rotatably provided in contact with a surface of a charge member, and that charges the surface of the charge member with contactors thereof. The contactors contact the surface of the charging member at charging areas. Directions of inclinations of the contactors differ in accordance with the charging areas.

BRIEF DESCRIPTION OF THE DRAWINGS

Exemplary embodiments of the present invention will be described in detail based on the following figures, wherein:

FIG. 10 is a table showing a summary of uneven charging when different charging voltages are applied to the first and second brush rollers, and uneven charging when the same charging voltage is applied to the first and second brush rollers;

FIG. 13A is a conceptual diagram showing a case in which two brush rollers rotate in a direction that is opposite to the direction of rotation of the photoconductor drum;

FIG. 13B is a conceptual diagram showing a case in which the two brush rollers are rotated in a direction that is the same as the direction of rotation of the photoconductor drum, and in which there is a difference between the rotational speed of the photoconductor drum and those of the brush rollers;

FIG. 14 is a table of a summary of uneven chargings in FIGS. 11A to 11C and FIGS. 13A and 13B and uneven charging in the exemplary embodiment;

DETAILED DESCRIPTION

Figure 1:
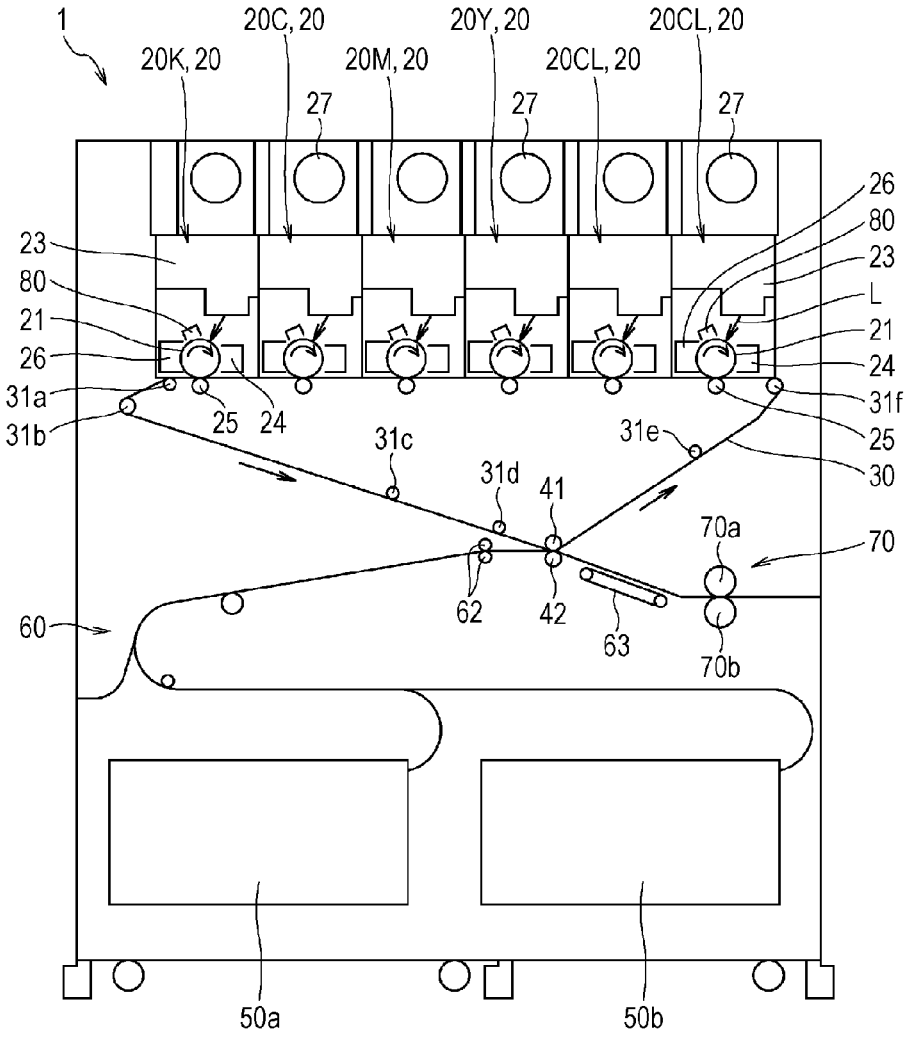
FIG. 1 is a conceptual diagram of an exemplary image forming apparatus according to an exemplary embodiment of the present invention.

Exemplary embodiments of the present invention will hereunder be described in detail on the basis of the drawings. In the drawings for illustrating the exemplary embodiments, corresponding structural elements are generally given the same reference numerals, and the same descriptions thereof will be omitted.

First Exemplary Embodiment

FIG. 1 is a conceptual diagram of an exemplary image forming apparatus 1 according to an exemplary embodiment of the present invention.

The image forming apparatus 1 according to the exemplary embodiment is, for example, a tandem color printer, and includes image forming units 20, an intermediate transfer belt 30, a backup roller 41 and a second transfer roller 42 that form a pair, sheet supply trays 50*a* and 50*b*, a sheet transporting system 60, and a fixing device 70.

The image forming units 20 include four color image forming units 20Y, 20M, 20C, and 20K and, for example, transparent-color image forming units 20CL and 20CL. The color image forming units 20Y, 20M, 20C, and 20K form, for example, toner images of corresponding colors, yellow, magenta, cyan, and black. The image forming units 20CL and 20CL transfer toner images of transparent colors. The toner images formed in accordance with pieces of image information of the corresponding colors are first-transferred to the intermediate transfer belt 30.

The six image forming units 20CL, 20CL, 20Y, 20M, 20C, and 20K are disposed in accordance with a transparent color, a transparent color, yellow, magenta, cyan, and black in that order along the direction of rotation of the intermediate transfer belt 30. Instead of the image forming units for transparent colors, for example, an image forming unit for a light color, such as light yellow, light magenta, light cyan, or light black, that transfers a toner image of a light color may be provided. Alternatively, an image forming unit 20CL for a transparent color and an image forming unit for a light color may both be disposed side by side.

Each image forming unit 20 includes a photoconductor drum (an exemplary charge member) 21, a charging device 80, an exposing device (an exemplary exposing unit) 23, a developing device (an exemplary developing unit) 24, a first transfer roller (an exemplary transferring unit) 25, and a drum cleaner 26. Each charging device 80 charges the surface of its corresponding photoconductor drum 21 to a prescribed potential. Each exposing device 23 irradiates the corresponding charged photoconductor drum 21 with laser light L to form an electrostatic latent image. Each developing device 24 develops the electrostatic latent image formed on the corresponding photoconductor drum 21 by the corresponding exposing device 23 to form a toner image. Each first transfer roller 25 transfers the toner image carried on its corresponding photoconductor drum 21 to the intermediate transfer belt 30 at a first transfer section. Each drum cleaner 26 removes, for example, residual toner or paper powder from the surface of its corresponding photoconductor drum 21 after the transfer of the toner image. Toner cartridges 27 that supply developer to the developing devices 24 are set at upper sides of the respective image forming units 20.

The first transfer rollers 25 of the corresponding image forming units 20 are disposed so that the first transfer rollers 25 and the corresponding photoconductor drums 21 nip the intermediate transfer belt 30. By applying a transfer bias voltage having a polarity that is opposite to that of a charging polarity of toner to each first transfer roller 25, electric fields are formed between the photoconductor drums 21 and the corresponding first transfer rollers 25. Therefore, the toner images that are charged on the corresponding photoconductor drums 21 are transferred to the intermediate transfer belt 30 by coulomb forces. The photoconductor drums 21 rotate clockwise during first transfer.

The intermediate transfer belt 30 is a member to which the toner images of the corresponding color components, formed by the corresponding image forming units 20, are successively transferred (first-transferred) for carrying the toner images. The intermediate transfer belt 30 is an endless belt that is placed on supporting rollers 31*a* to 31*f* and the backup roller 41. The toner images formed by the corresponding image forming units 20CL, 20CL, 20Y, 20M, 20C, and 20K are first-transferred to the intermediate transfer belt 30 while the intermediate transfer belt 30 rotates counterclockwise in a peripheral direction.

The backup roller 41 and the second transfer roller 42 that form a pair constitute a mechanism for forming a full-color image by collectively transferring (second-transferring) the toner images transferred to and superimposed on the intermediate transfer belt 30 to, for example, a sheet (an exemplary transfer material), and are disposed so as to oppose each other with the intermediate transfer belt 30 being nipped therebetween. A portion where the backup roller 41 and the second transfer roller 42 oppose each other corresponds to a second transfer section.

The backup roller 41 is rotatably set at the inner surface of the intermediate transfer belt 30. The second transfer roller 42 is rotatably set while opposing a toner-image transfer surface of the intermediate transfer belt 30. The backup roller 41 and the second transfer roller 42 are disposed so that their directions of rotational axes (that is, their directions perpendicular to the plane of FIG. 1) are parallel to each other.

When transferring the toner images on the intermediate transfer belt 30, a voltage whose polarity is the same as the toner charging polarity is applied to the backup roller 41, or a voltage whose polarity is opposite to the toner charging polarity is applied to the second transfer roller 42. This causes a transfer electric field to be formed between the backup roller 41 and the second transfer roller 42, so that unfixed toner images carried by the intermediate transfer belt 30 are transferred to a sheet.

For example, sheets of various sizes and thicknesses are held in the sheet supply trays 50*a* and 50*b*. The sheets in the sheet supply trays 50*a* and 50*b* are drawn out by a pickup roller (not shown) of the sheet transporting system 60. Then, a timing is controlled by registration rollers 62 of the sheet transporting system 60, and the sheets are introduced into the second transfer section, so that the toner images are transferred to the sheets. Thereafter, the sheets are transported to the fixing device 70 by transporting belts 63 and 64 of the sheet transporting system 60.

The fixing device 70 fixes unfixed toner images, transferred to, for example, a sheet at the second transfer section, to the sheet by thermocompression. The fixing device 70 includes a heating roller 70*a* and a pressure roller 70*b*, provided so as to oppose the heating roller 70*a*.

After the second transfer, the sheet is transported to a fixing nip where the heating roller 70*a* and the pressure roller 70*b* oppose each other, and is discharged while being nipped between the heating roller 70*a* and the pressure roller 70*b*. At this time, for example, the sheet is heated by the heating roller 70*a*, and is pressed by the pressure roller 70*b*, so that the toner images are fixed to, for example, the sheet. For example, the sheet that has passed through the fixing device 70 is sent to a discharge roller (not shown) by a transporting belt 65, and is discharged to the outside of the image forming apparatus 1.

Figure 2:
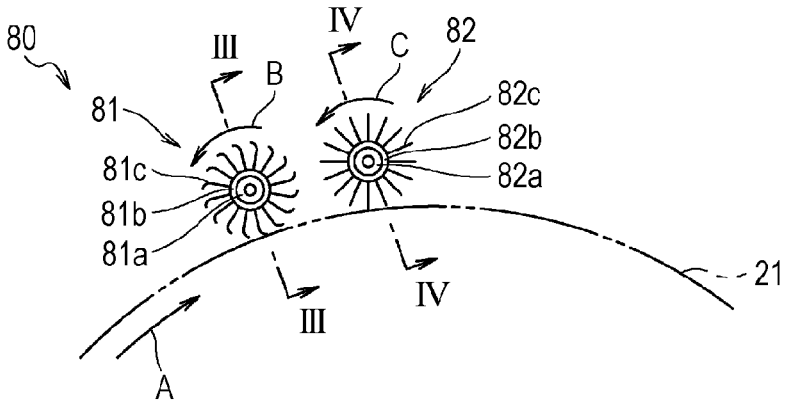
FIG. 2 is a conceptual diagram of brush rollers of a charging device of the image forming apparatus shown in FIG. 1 as seen from end surfaces of the brush rollers in an axial direction of the brush rollers.
Figure 3:
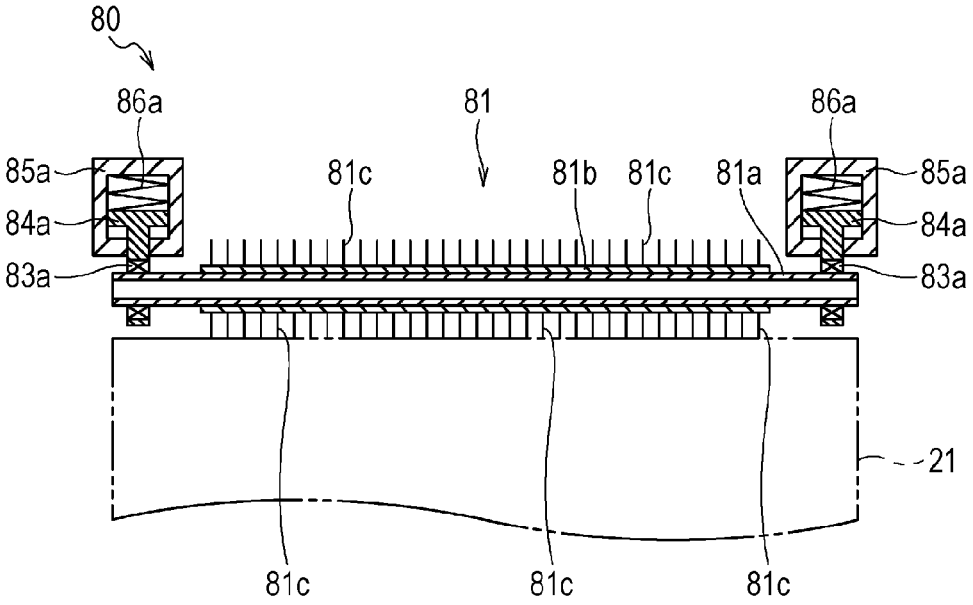
FIG. 3 is a sectional view taken along line III-III in FIG. 2.
Figures 4, 5:
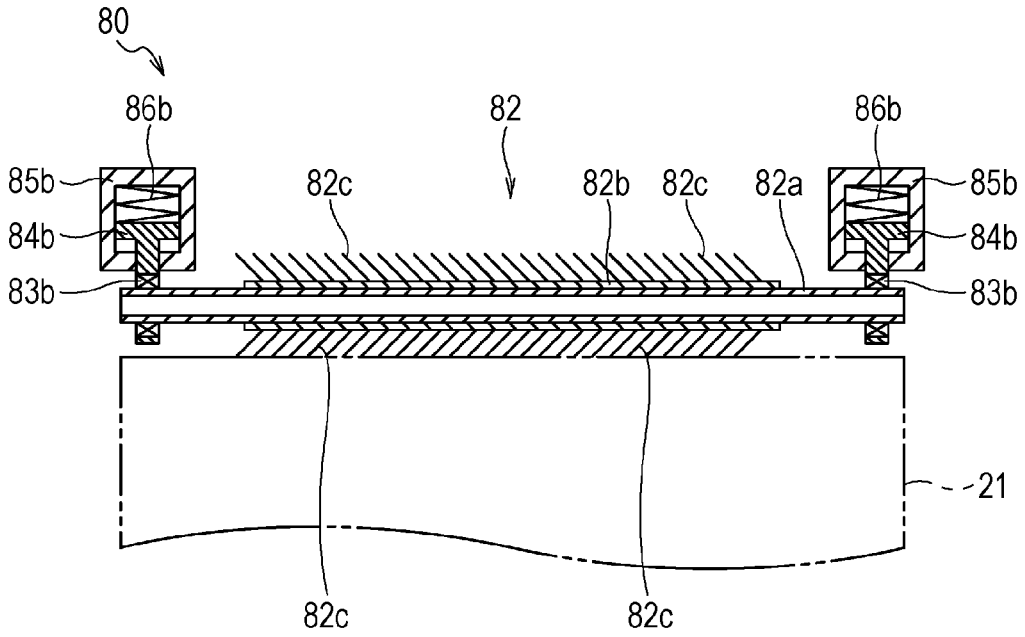
FIG. 4 is a sectional view taken along line IV-IV in FIG. 2.
FIG. 5 is a table of a summary of uneven charging when only a first brush roller is used, when only a second brush roller is used, and when both the first and second brush rollers are used.

FIG. 2 is a conceptual diagram of the brush rollers 81 and 82 of the charging device 80 as seen from end surfaces of the brush rollers 81 and 82 in an axial direction of the brush rollers 81 and 82. FIG. 3 is a sectional view taken along line III-III in FIG. 2, and FIG. 4 is a sectional view taken along line IV-IV in FIG. 2.

The charging device 80 includes two charging brushes, that is, the first brush roller (exemplary first charging member and exemplary first charging area) 81 and the second brush roller (exemplary second charging member and exemplary second charging area) 82 that is provided separately from the first brush roller 81.

The first brush roller 81 is provided at an upstream side in the direction of rotation of its corresponding photoconductor drum 21. The second brush roller 82 is provided at a downstream side in the direction of rotation of its corresponding photoconductor drum 21. The first brush roller 81 and the second brush roller 82 are provided in rotatable states so as to be driven in accordance with the rotation of the photoconductor drum 21. Arrow A in FIG. 1 represents the direction of rotation of the photoconductor drum 21. Arrows B and C represent the direction of rotation of the first brush roller 81 and the direction of rotation of the second brush roller 82, respectively.

The first brush roller 81 is formed of an electrostatic implantation brush including a shaft 81*a*, a conductive adhesive layer 81*b*, and contactors 81*c*. The second brush roller 82 is formed of an electrostatic implantation brush including a shaft 82*a*, a conductive adhesive layer 82*b*, and contactors 82*c*. Each of the shafts 81*a* and 82*a* is formed of, for example, a conductive metal, such as stainless steel or aluminum. The adhesive layers 81*b* and 82*b* are applied to outer peripheral surfaces of the corresponding shafts 81*a* and 82*a*. The contactors 81*c* are provided at the adhesive layer 81*b* by electrostatic implantation. The contactors 82*c* are provided at the adhesive layer 82*b* by electrostatic implantation.

However, the first brush roller 81 and the second brush roller 82 are not limited to electrostatic implantation brushes. They may be, for example, pile-weaving brushes formed by spirally affixing laces to the respective shafts 81*a* and 82*a* with, for example, a conductive adhesive. The laces are formed by pile-weaving the contactors 81*c* and 82*c*.

As shown in FIGS. 3 and 4, the shaft 81*a* is rotatably supported by shaft receiving portions 83*a* provided at respective ends of the shaft 81*a*, and the shaft 82*a* is rotatably supported by shaft receiving portions 83*b* provided at respective ends of the shaft 82*a*. The shaft receiving portions 83*a* and 83*b* are, for example, bearings, and are supported by sliders 84*a* and sliders 84*b*, respectively. The sliders 84*a* and the sliders 84*b* are supported so as to be movable towards and away from the photoconductor drum 21 while being accommodated in slider guides 85*a* and slider guides 85*b*, respectively.

Coil springs 86*a* are set between top surfaces of the respective sliders 84*a* and inner top surfaces of the respective slide guides 85*a*. The coil springs 86*b* are set between top surfaces of the respective sliders 84*b* and inner top surfaces of the respective slide guides 85*b*. The sliders 84*a* and 84*b* are urged towards the photoconductor drum 21. This causes the first brush roller 81 and the second brush roller 82 to be urged towards the photoconductor drum 21. As a result, the contactors 81*c* at the outer periphery of the first brush roller 81 and the contactors 82*c* at the outer periphery of the second brush roller 82 are lightly pushed against the surface of the photoconductor drum 21.

For example, a direct-current constant-voltage power supply (hereunder referred to as a DC power supply; not shown in FIGS. 2 to 4) is electrically connected to the respective shafts 81*a* and 82*a*. The DC power supply is a power supply for supplying charging voltage. The DC power supply will be described later.

The contactors 81*c* and the contactors 82*c* are formed of, for example, conductive fibers containing carbon, and are electrically connected to the corresponding shafts 81*a* and 82*a*, with an end of each of the contactors 81*c* and 82*c* being lightly pushed against the surface of the photoconductor drum 21 so as to contact the surface of the photoconductor drum 21.

In such a charging device 80 including the first brush roller 81 and the second brush roller 82, when a direct-current voltage is applied to the shaft 81*a* of the first brush roller 81 and the shaft 82*a* of the second brush roller 82 from the DC power supply, proximity discharge is generated in a very small gap at a contact portion of the contactors 81*c* of the first brush roller 81 and the surface of the photoconductor drum 21 and in a very small gap at a contact portion of the contactors 82*c* of the second brush roller 82 and the surface of the photoconductor drum 21. This causes the surface of the photoconductor drum 21 to be charged to a previously set charging potential.

In general, portions of a brush roller provided with contactors are charged, whereas portions of the brush roller that are not provided with contactors are difficult to charge. Increasing the density of the contactors is effective in reducing uneven charging on the surface of the photoconductor drum 21. However, there is a limit to the number of contactors that is capable of being increased. Therefore, uneven charging essentially occurs.

Consequently, in the exemplary embodiment, the direction of inclination of the contactors 81*c* at the charging area of the first brush roller 81 and the direction of inclination of the contactors 82*c* in the charging area of the second brush roller 82 are set so as to differ from each other. For example, the direction of inclination of the contactors 81*c* at the charging area of the first brush roller 81 (disposed at the upstream side in the direction of rotation of the photoconductor drum 21) is provided along the direction of rotation of the photoconductor drum 21. In addition, for example, the direction of inclination of the contactors 82*c* at the charging area of the second brush roller 82 (disposed at the downstream side in the direction of rotation of the photoconductor drum 21) is provided along a direction (an axial direction) that crosses the direction of rotation of the photoconductor drum 21.

This causes a portion of the photoconductor drum 21 that is not charged at the charging area of the first brush roller 81 to be charged at the charging area of the following second brush roller 82. That is, one of the first and second brush rollers 81 and 82 is effective in compensating for insufficient charging by the other of the first and second brush rollers 81 and 82. In particular, when the direction of inclination of the contactors 81*c* of the first brush roller 81 and the direction of inclination of the contactors 82*c* of the second brush roller 82 cross each other, potentials are supplemented by the first and second brush rollers 81 and 82.

Here, when only the first brush roller 81 is used, portions that are provided with contactors 81*c* and portions that are not provided with contactors 81*c* are alternately provided along the axial direction (longitudinal direction) of the shaft 81*a*. Therefore, when charging is performed, small uneven charging tends to be occur along the axial direction of the shaft 81*a*, as a result of which defects in the form of vertical streaks tend to be included in an image. When, for example, only the second brush roller 82 is used, portions that are provided with contactors 82*c* and portions that are not provided with contactors 82*c* are alternately provided along the direction of rotation thereof. Therefore, when charging is performed, small uneven charging tends to occur along a peripheral direction, as a result of which defects in the form of horizontal streaks tend to be included in an image.

In contrast, in the exemplary embodiment, when charging is performed using the two brush rollers 81 and 82 having the above-described structures, an effect which is equivalent to that obtained by increasing the density of the contactors of the brush rollers is obtained, so that uneven charging on the surface of the photoconductor drum 21 is reduced. Therefore, image uniformity is increased, so that the generation of image defects is suppressed or prevented.

FIG. 5 is a table of a summary of uneven charging when only the first brush roller 81 is used, when only the second brush roller 82 is used, and when both the first and second brush rollers 81 and 82 are used. When only the first brush roller 81 is used, uneven charging is 35 V. When only the second brush roller 82 is used, uneven charging is 38 V. In contrast, in the exemplary embodiment, uneven charging is 13 V, so that it is understood that uneven charging is reduced.

Next, charging voltages that are applied to the first and second brush rollers 81 and 82 at the time of charging will be described with reference to FIGS. 6 to 10.

Figure 6:
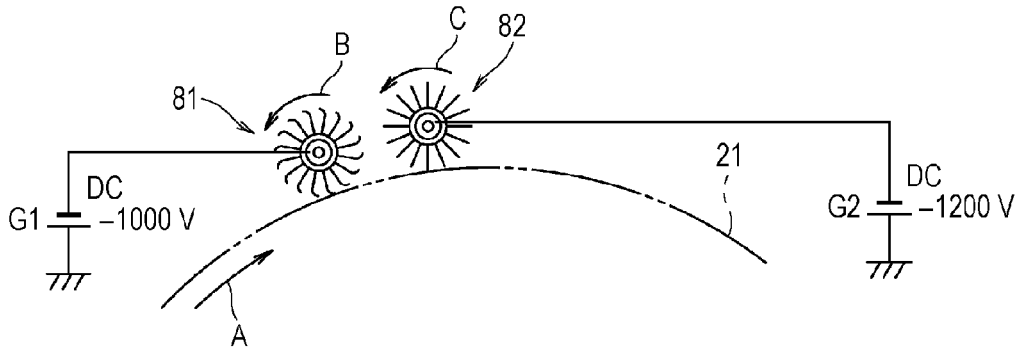
FIG. 6 is a conceptual diagram of an exemplified case in which different charging voltages are applied to the first and second brush rollers.

FIG. 6 exemplifies a case in which different charging voltages are applied to the first and second brush rollers. A DC power supply G1 applies a relatively low voltage of, for example −1000 V to the first brush roller 81 disposed at the upstream side in the direction of rotation of the photoconductor drum 21. A DC power supply G2 applies a relatively high voltage of, for example, −1200 V to the second brush roller 82 disposed at the downstream side in the direction of rotation of the photoconductor drum 21.

Figure 7A:
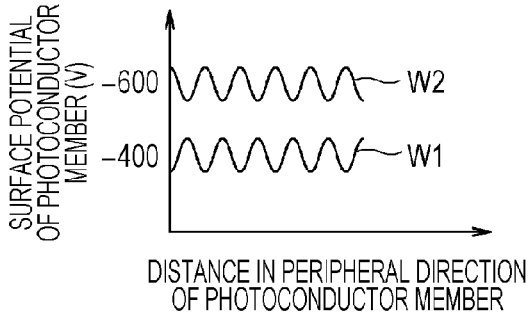
FIG. 7A is a wave-form graph showing the surface potentials of a photoconductor drum that are generated by the first and second brush rollers to which different charging voltages are applied.
Figure 7B:
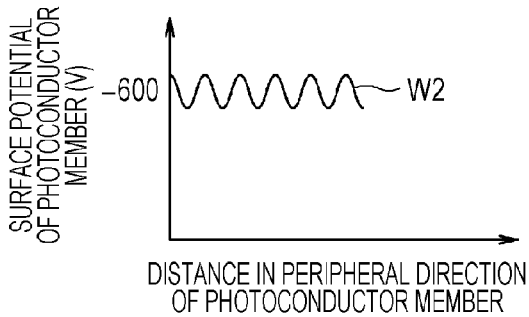
FIG. 7B is a wave-form graph showing the final surface potential of the photoconductor drum.

In this case, as shown in FIG. 7A, after the photoconductor drum 21 passes the first brush roller 81 at the upstream side in the direction of rotation of the photoconductor drum 21, a waveform W1 of uneven charging that is generated on the surface of the photoconductor drum 21 is generated. In addition, as shown in FIG. 7A, after the photoconductor drum 21 passes the second brush roller 81 at the downstream side in the direction of rotation of the photoconductor drum 21, a waveform W2 of uneven charging generated on the surface of the photoconductor drum 21 is generated. Eventually, as shown in FIG. 7B, the uneven charging follows the higher voltage applied at the downstream side in the direction of rotation of the photoconductor drum 21, as a result of which the uneven charging becomes the same as that when the photoconductor drum 21 is charged by only the second brush roller 82.

Figure 8:
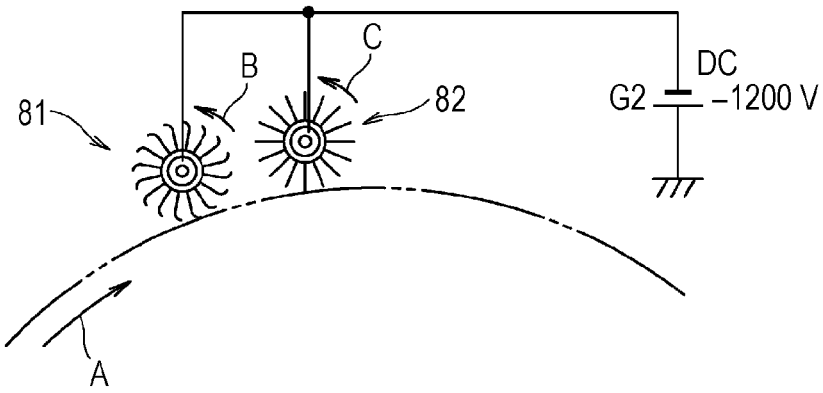
FIG. 8 is a conceptual diagram of an exemplified case in which the same charging voltage is applied to the first brush roller and the second brush roller from the same power supply.

Therefore, in the exemplary embodiment, as shown in FIG. 8, the same DC voltage G applies the same voltage (exemplary common voltage) to the first brush roller 81 and the second brush roller 82.

Figure 9A:
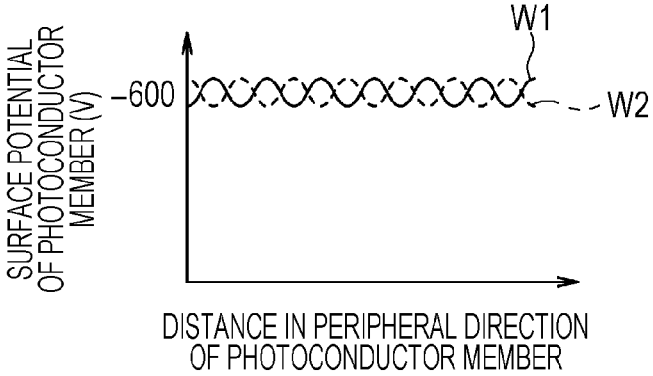
FIG. 9A is a wave-form graph showing the surface potentials of the photoconductor drum that are generated by the first and second brush rollers to which the same charging voltage is applied.
Figure 9B:
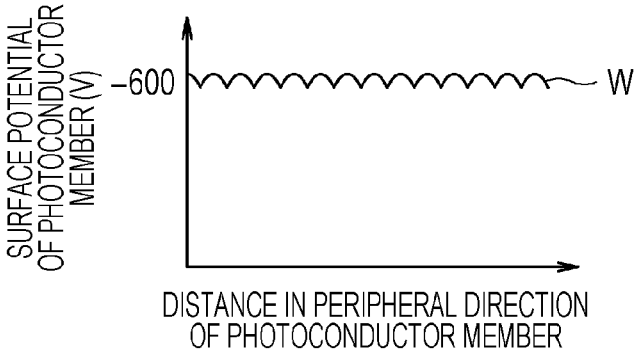
FIG. 9B is a wave-form graph showing the final surface potential of the photoconductor drum.

In this case, in addition to the first brush roller 81 and the second brush roller 82 being disposed so as to be shifted from each other in the direction of rotation of the photoconductor drum 21, as described above, the direction of inclination of the contactors 81*c* of the first brush roller 81 and the direction of inclination of the contactors 82*c* of the second brush roller 82 are purposely caused to differ from each other. Therefore, as shown in FIG. 9A, a low potential caused by the first brush roller 81 at the upstream side in the direction of rotation of the photoconductor drum 21 is replenished by a high potential caused by the second brush roller 82 at the downstream side in the direction of rotation of the photoconductor drum 21. In contrast, a low potential caused by the second brush roller 82 at the downstream side in the direction of rotation of the photoconductor drum 21 is replenished by a high potential caused by the first brush roller 81 at the upstream side in the direction of rotation of the photoconductor drum 21. As a result, as shown in FIG. 9B, a waveform W of uneven charging on the surface of the photoconductor drum 21 becomes gentle. Therefore, the uneven charging of the photoconductor drum 21 caused by the charging device 80 is effectively reduced.

FIG. 10 is a table showing a summary of uneven charging when different charging voltages are applied to the first and second brush rollers 81 and 82, and uneven charging when the same charging voltage is applied to the first and second brush rollers 81 and 82. When different voltages are applied, uneven charging is 38 V, whereas in the exemplary embodiment in which the same voltage is applied, uneven charging is 13 V, so that it is understood that uneven charging is reduced.

However, although, in the exemplary embodiment, the same DC power supply G applies the same voltage to the first brush roller 81 and the second brush roller 82, the present invention is not limited thereto. Different DC power supplies may apply the same voltage.

Next, the changes in the states of inclinations of the contactors of the charging brushes with time will be described with reference to FIGS. 11A to 14.

Figure 11A:
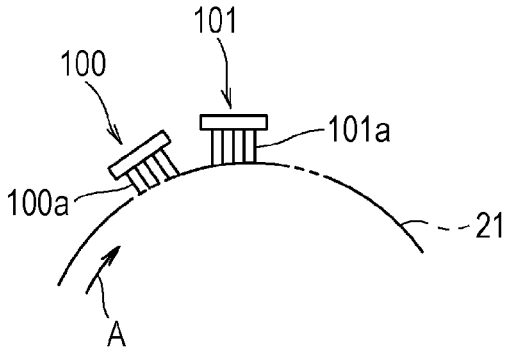
FIG. 11A is a conceptual diagram of a case in which two flat brushes are used.

FIG. 11A is a conceptual diagram of a case in which two flat brushes 100 and 101 are used as charging brushes. The flat brushes 100 and 101 are disposed side by side along the direction of rotation of the photoconductor drum 21. Contactors 100*a* and 101*a* are provided at the lower surfaces of the flat brushes 100 and 101, respectively, so as to contact the surface of a photoconductor drum 21.

Figure 11B:
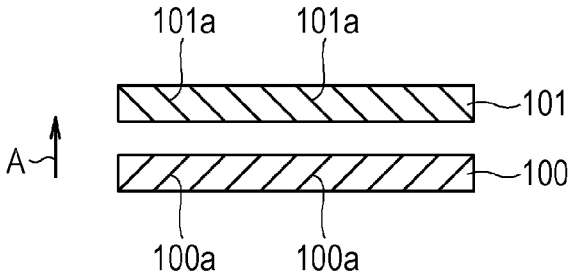
FIG. 11B is a plan view showing directions of inclinations of contactors of the two flat brushes in an initial stage.
Figure 11C:
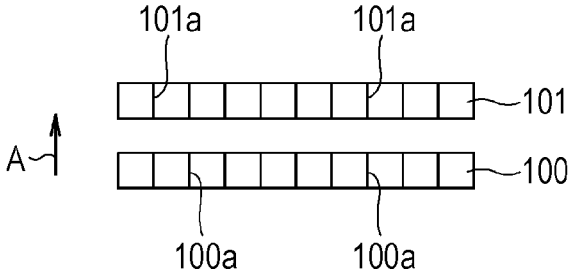
FIG. 11C is a plan view showing directions of inclinations of contactors of the two flat brushes after the passage of time.

FIG. 11B shows the directions of inclinations of the contactors 100*a* and 101*a* of the two flat brushes 100 and 101, respectively, at an initial stage, and FIG. 11C shows the directions of inclinations of the contactors 100*a* and 101*a* of the two flat brushes 100 and 101, respectively, after the passage of time. In this case, as shown in FIG. 11B, at the initial stage, the direction of inclination of the contactors 100*a* of the flat brush 100 and the direction of inclination of the contactors 101*a* of the flat brush 101 differ from each other, which is good. However, as shown in FIG. 11C, the direction of inclination of the contactors 100*a* and the direction of inclination of the contactors 101*a* change with time so as to be oriented in the direction of rotation of the photoconductor drum 21, as a result of which the effect is soon lost.

Figure 12A:
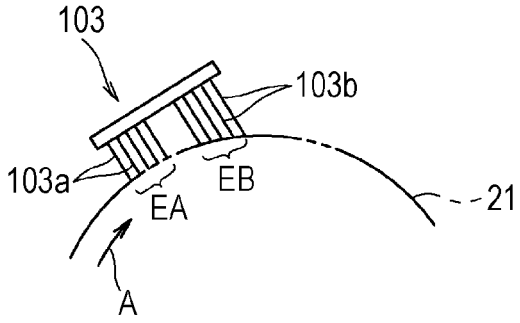
FIG. 12A is a conceptual diagram of a case in which one flat brush is used.

FIG. 12A shows a case in which one flat brush 103 is used as a charging brush. Charging areas EA and EB are disposed at the flat brush 103 along the direction of rotation of a photoconductor drum 21. The direction of inclination of contactors 103*a* at the charging area EA and the direction of inclination of contactors 103*b* at the charging area EB differ from each other.

Figure 12B:
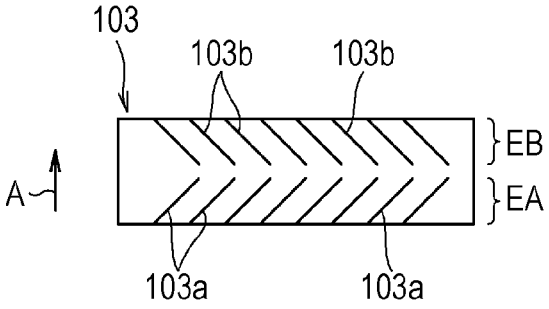
FIG. 12B is a plan view of directions of inclinations of contactors in charging areas of one flat brush in an initial stage.
Figure 12C:
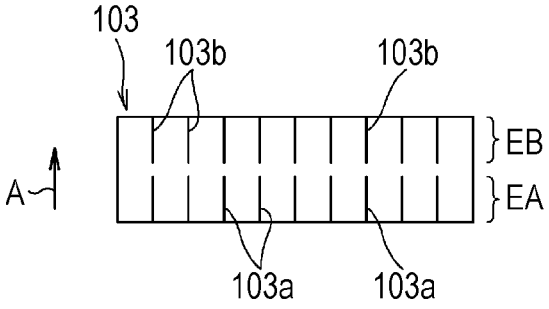
FIG. 12C is a plan view of directions of inclinations of contactors in the charging areas of one flat brush after the passage of time.

FIG. 12B shows the direction of inclination of contactors 103*a* at the charging area EA and the direction of inclination of contactors 103*b* at the charging area EB of the flat brush 103 at an initial stage. FIG. 12C shows the direction of inclination of contactors 103*a* at the charging area EA and the direction of inclination of contactors 103*b* at the charging area EB of the flat brush 103 after the passage of time. Even in this case, as shown in FIG. 12B, at the initial stage, the direction of inclination of the contactors 103*a* of the flat brush 103 and the direction of inclination of the contactors 103*b* of the flat brush 103 differ from each other, which is good. However, as shown in FIG. 11C, the direction of inclination of the contactors 103*a* and the direction of inclination of the contactors 103*b* change with time so as to be oriented in the direction of rotation of the photoconductor drum 21, as a result of which the effect is soon lost.

Further, FIGS. 13A and 13B show cases in which two brush rollers 81 and 82 are used as charging brushes. In both cases, the direction of inclination of the contactors 81*c* of the brush roller 81 and the direction of inclination of the contactors 82*c* of the brush roller 82 differ from each other.

FIG. 13A shows the case in which the two brush rollers 81 and 82 are rotated in a direction that is opposite to the direction of rotation of a photoconductor drum 21 as indicated by arrows D and E, respectively. FIG. 13B shows the case in which the two brush rollers 81 and 82 are rotated in a direction that is the same as the direction of rotation of the photoconductor drum 21 as indicated by arrows F and H, respectively, and in which there is a difference between the rotational speed of the photoconductor drum 21 and those of the brush rollers 81 and 82. In both cases, the orientations of the contactors 81*c* and 82*c* are gradually aligned with the direction of rotation of the photoconductor drum 21, as a result of which the effect does not continue.

Therefore, in the exemplary embodiment, the first brush roller 81 and the second brush roller 82 are driven in accordance with the rotation of the photoconductor drum 21. This causes the orientation of the initially set contactors 81*c* of the first brush roller 81 and the orientation of the initially set contactors 82*c* of the second brush roller 82 to be maintained after the passage of time. Consequently, uneven charging is reduced for a long period of time.

However, although, in the exemplary embodiment, the case in which the first brush roller 81 and the second brush roller 82 are driven in accordance with the rotation of the photoconductor drum 21 is described, all that is required is for the directions and peripheral speeds of the rotations of the first and second brush rollers 81 and 82 to be set so as to match the direction and peripheral speed of the rotation of the photoconductor drum 21. For example, the first brush roller 81 and the second brush roller 82 may be driven by, for example, separate motors so as to rotate in a direction that is the same as that of the rotation of the photoconductor drum 21 and with a speed that is the same as that of the rotation of the photoconductor drum 21.

FIG. 14 is a table of a summary of uneven chargings in FIGS. 11A to 11C and FIGS. 13A and 13B and uneven charging in the exemplary embodiment. When the two flat brushes 100 and 101 are used, initial uneven charging is 15 V, and uneven charging after the passage of time is 42 V. When the two brush rollers 81 and 82 are driven in the opposite direction or when there is a difference between the speed of the photoconductor drum 21 and the rotational speeds of the two brush rollers 81 and 82, initial uneven charging is 13 V, and uneven charging after the passage of time is 36 V. In contrast, in the exemplary embodiment in which the first brush roller 81 and the second brush roller 82 are driven in accordance with the rotation of the photoconductor drum 21, initial uneven charging is 13 V, and uneven charging after the passage of time is 20 V. Therefore, it is understood that the uneven charging after the passage of time in the exemplary embodiment is kept lower than that in FIGS. 11A to 11C and that in FIGS. 13A and 13B.

Second Exemplary Embodiment

Figure 15:
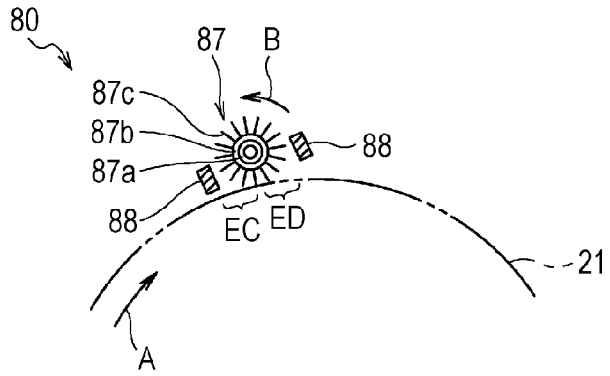
FIG. 15 is a conceptual diagram of a brush roller of a charging device of the image forming apparatus shown in FIG. 1 as seen from an end surface of the brush roller in an axial direction of the brush roller.
Figure 16:
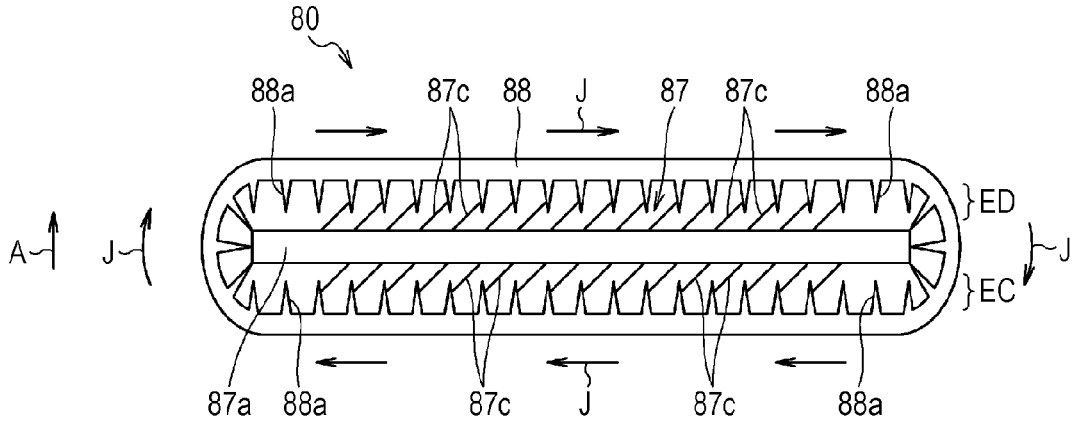
FIG. 16 is a plan view of the brush roller shown in FIG. 15 as seen from the top of the brush roller.

FIG. 15 is a conceptual diagram of a brush roller 87 of a charging device 80 according to a second exemplary embodiment as seen from an end surface of the brush roller 87 in an axial direction of the brush roller 87. FIG. 16 is a plan view of the brush roller 87 shown in FIG. 15 as seen from the top of the brush roller 87.

As in the first exemplary embodiment, the brush roller (one exemplary charging member) 87 is formed of an electrostatic implantation brush including a shaft 87*a*, a conductive adhesive layer 87*b*, and contactors 87*c*. The shaft 87*a* is formed of, for example, a conductive metal, such as stainless steel or aluminum. The adhesive layer 87*b* is applied to an outer peripheral surface of the shaft 87*a*. The contactors 87*c* are provided at the adhesive layer 87*b* by electrostatic implantation. The contactors 87*c* are provided at the adhesive layer 87*b* by electrostatic implantation.

As in the first exemplary embodiment, the brush roller 87 is also not limited to an electrostatic implantation brush. It may be, for example, a pile-weaving brush formed by spirally affixing a lace to the shaft 87*a* with, for example, a conductive adhesive. The lace is formed by pile-weaving the contactors 87*c*.

Here, in the one brush roller 87, the direction of inclination of contactors 87*c* at a charging area (an exemplary first charging area) EC at an upstream side (upstream side in the direction of rotation of the photoconductor drum 21) and the direction of inclination of contactors 87*c* at a charging area (an exemplary second charging area) ED at a downstream side (downstream side in the direction of rotation of the photoconductor drum 21) are caused to differ from each other. The structure of supplying charging voltage to the brush roller 87 and the particulars regarding the direction of rotation and the rotational speed of the brush roller 87 are the same as those in the first exemplary embodiment.

According to the second exemplary embodiment, as in the first exemplary embodiment, uneven charging at the surface of the photoconductor drum 21 is reduced. Since only one brush roller 87 is used, the size of the charging device 80 when only one brush roller 87 is used is smaller than the size of the charging device 80 when two brush rollers are used.

An inclining member (a first exemplary inclining member, a second exemplary inclining member) 88 is provided at a lower portion of an outer periphery of the brush roller 87. The inclining member 88 is a member that performs a inclination operation so that the contactors 87*c* at the upstream side charging area EC and the contactors 87*c* at the downstream side charging area ED are inclined in different directions. As shown in FIG. 16, the inclining member 88 is formed as an endless frame that surrounds the brush roller 87.

Protrusions 88*a* extending towards the centers of the frames are provided in a comblike form at the inner periphery of the inclining member 88. The protrusions 88*a* are provided so as to contact respective contactors 87*c* at the upstream side charging area EC and at the downstream side charging area ED.

Therefore, when the inclining member 88 is rotated and moved in a peripheral direction (in the direction of arrows J in FIG. 16), the contactors 87*c* at the upstream side charging area EC are inclined in a first direction, and the contactors 87*c* at the downstream side charging area ED are inclined in a second direction that is opposite to the first direction.

Consequently, by the rotations of the inclining member 88 in the peripheral direction, the orientations of the contactors 87*c* are maintained even after the passage of time at both the upstream side and the downstream side of the initially set brush roller 87. Therefore, uneven charging at the surface of the photoconductor drum 21 is suppressed for a long period of time.

Since the directions of inclinations of the contactors 87*c* at the two charging areas EC and ED are capable of being changed by one inclining member 88, the number of parts is reduced, and control for inclination operations is facilitated. However, it is possible to separately provide an inclining member at the upstream side charging area EC and an inclining member at the downstream side charging area ED, and perform an inclination operation on the contactors 87*c*. In this case, since the inclining members are capable of being separately moved, the directions of inclinations of the contactors 87*c* are capable of being variously changed.

Third Exemplary Embodiment

Figure 17:
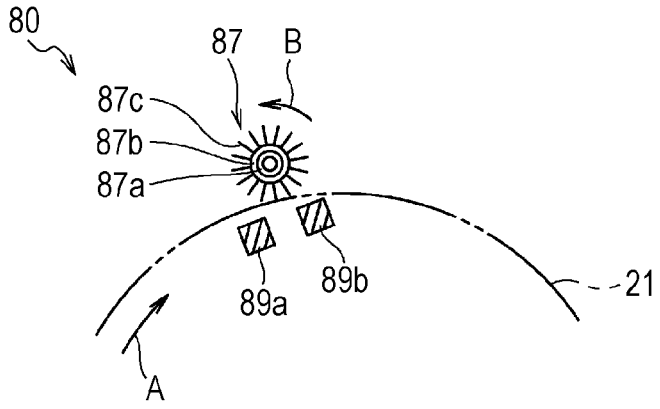
FIG. 17 is a conceptual diagram of a brush roller of a charging device of the image forming apparatus shown in FIG. 1 as seen from an end surface of the brush roller in an axial direction of the brush roller.
Figure 18:
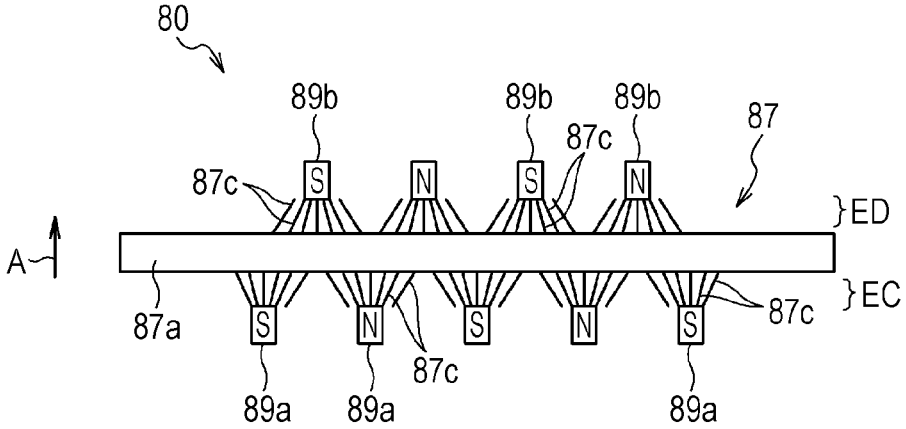
FIG. 18 is a plan view of the brush roller shown in FIG. 17 as seen from the top of the brush roller.

FIG. 17 is a conceptual diagram of a brush roller 87 of a charging device 80 according to a third exemplary embodiment as seen from an end surface of the brush roller 87 in an axial direction of the brush roller 87. FIG. 18 is a plan view of the brush roller 87 shown in FIG. 17 as seen from the top of the brush roller 87.

In the third exemplary embodiment, all contactors 87*c* of the brush roller 87 contain magnetic material, and inclining members (a third exemplary inclining member, a fourth exemplary inclining member) 89*a* and 89*b* of the contactors 87*c* are formed of magnets. In FIG. 18, symbols N and S represent magnetic poles of the magnets. The structure of supplying charging voltage to the brush roller 87 and the particulars regarding the direction of rotation and the rotational speed of the brush roller 87 are the same as those in the first exemplary embodiment.

As shown in FIG. 17, the inclining members 89*a* are provided so that their positions are fixed in an inner portion of a photoconductor drum 21 below a upstream side charging area EC. The inclining members 89*b* are provided so that their positions are fixed in an inner portion of the photoconductor drum 21 below a downstream side charging area ED. However, the inclining members 89*a* and 89*b* may be provided outside the photoconductor drum 21.

As shown in FIG. 18, the inclining members 89*a* are disposed so that, at the upstream side charging area EC, N poles and S poles are alternately disposed adjacent to each other in accordance with each preset interval along an axial direction of the brush roller 87. The inclining members 89*b* are disposed so that, at the downstream side charging area ED, N poles and S poles are alternately disposed adjacent to each other in accordance with each preset interval along the axial direction of the brush roller 87.

However, the inclining members 89*a* and 89*b* are disposed in a shifted state in the axial direction of the brush roller 87 so that each inclining member 89*b* at the downstream side is positioned between adjacent upstream side inclining members 89*a*. The upstream side contactors 87*c* are inclined in a first state by magnetic forces of the inclining members 89*a*. The downstream side contactors 87*c* are inclined in a second state differing from the first state by magnetic forces of the inclining members 89*b*. The state of inclination of the contactors 87*c* (distribution of inclination of the contactors 87*c*) at the upstream side and that at the downstream side differ from each other.

Since, in this way, an inclination operation is performed so that the state of inclination of the contactors 87*c* at the upstream side and the state of inclination of the contactors 87*c* at the downstream side of one brush roller 87 differ from each other, uneven charging at the surface of the photoconductor drum 21 is reduced as in the first exemplary embodiment. In addition, since the states of inclinations of the contactors 87*c* result from the magnetic forces of the inclining members 89*a* and 89*b*, the orientations of the upstream side contactors 87*c* and the downstream side contactors 87*c* of the brush roller 87 at the time of initial setting are maintained even after the passage of time. Therefore, uneven charging at the surface of the photoconductor drum 21 is reduced for a long period of time. Further, since only one brush roller 87 is required, and the inclining members 89*a* and 89*b* are provided in the internal portions of the photoconductor drum 21, the charging device 80 is smaller than that according to the second exemplary embodiment.

Although the invention carried out by the inventors is described in detail on the basis of exemplary embodiments, the exemplary embodiments disclosed in the specification are exemplifications on all points, and should not to be thought of as limiting the disclosed technology. That is, the technical scope of the present invention is not to be construed in a limited sense on the basis of the explanation in the exemplary embodiments. The technical scope of the present invention should be strictly construed in accordance with the scope of the claims. Accordingly, technologies that are equivalent to the technology that is set forth in the scope of the claims and all modifications that do not depart from the gist of the scope of the claims are included.

For example, although, in the exemplary embodiments, the invention is applied to an intermediate-transfer image forming apparatus that transfers a toner image transferred to the intermediate transfer belt to a sheet is described, the invention is not limited thereto. The invention may be applied to a direct-transfer image forming apparatus that directly transfers a toner image on a photoconductor drum to, for example, a sheet.

Although, in the exemplary embodiments, the formation of color images is described, for example, monochrome images may be formed.

Although, in the exemplary embodiments, a sheet is used as a recording medium, the present invention is not limited thereto. For example, a film, a postcard, or various other materials on which images are formed may be used.

Although, in the first exemplary embodiment, two brush rollers are used, three brush rollers may also be used. Even in this case, the directions of inclinations of the contactors of the brush rollers are made different from each other.

Even in the first exemplary embodiment, the inclining members described in the second exemplary embodiment or the third exemplary embodiment may be provided.

Although, in the foregoing description, the present invention is applied to a color printer, the present invention may be applied to, for example, a color copying machine, a facsimile, an image forming apparatus having the functions of both the color copying machine and the facsimile, and other types of image forming apparatuses.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that is rotatably provided in contact with a surface of a charge member, the charging member charging the surface of the charge member with a plurality of contactors thereof, wherein the contactors contact the surface of the charging member at a plurality of charging areas, and directions of inclinations of the contactors differ in accordance with the plurality of charging areas.

2. The charging device according to claim 1, wherein the charging member includes a first charging member and a second charging member, the first charging member being provided at an upstream side in a direction of rotation of the charge member, the second charging member being provided at a downstream side in the direction of rotation of the charge member, the second charging member being provided separately from the first charging member, and wherein the direction of inclination of the contactors at a charging area of the first charging member and the direction of inclination of the contactors at a charging area of the second charging member differ from each other.

3. The charging device according to claim 1, wherein the charging member includes a first charging member and a second charging member, wherein the contactors at a charging area of the first charging member are provided so that a direction of inclination thereof is along a direction of rotation of the charge member, and wherein the contactors at a charging area of the second charging member are provided so that a direction of inclination thereof crosses the direction of rotation of the charge member.

4. The charging device according to claim 1, wherein the charging member includes one charging member, wherein the one charging member includes a first plurality of contactors and a second plurality of contactors, the first contactors being provided at an upstream side in a direction of rotation of the charge member, the second contactors being provided at a downstream side in the direction of rotation of the charge member, and wherein a state of inclination of the first contactors and a state of inclination of the second contactors differ from each other.

5. The charging device according to claim 4, further comprising a first inclining member that is provided so as to contact the first contactors, the first inclining member inclining the first contactors in a first direction, and a second inclining member that is provided so as to contact the second contactors, the second inclining member inclining the second contactors in a second direction differing from the first direction.

6. The charging device according to claim 4, further comprising a first inclining member that inclines the first contactors in a first direction by magnetic force, and a second inclining member that inclines the second contactors in a second direction differing from the first direction by magnetic force, wherein each of the first and second contactors is magnetic.

7. The charging device according to claim 1, wherein a same voltage is applied to the plurality of charging areas.

8. The charging device according to claim 1, wherein the charging member is provided so as to rotate in a first direction and the charge member rotates in a second direction that is opposite to the first direction and the charging member and the charge member rotate at a same peripheral speed.

9. An image forming apparatus comprising:

the charging device according to claim 1 that charges the surface of the charge member;

an exposing unit that exposes the charge member and forms a latent image on the charge member;

a developing unit that develops the latent image; and a transferring unit that transfers a developed image to a transfer material.

* * * * *